US009121248B2

(12) United States Patent
Hofman et al.

(10) Patent No.: US 9,121,248 B2
(45) Date of Patent: Sep. 1, 2015

(54) DOWNHOLE SYSTEM AND APPARATUS INCORPORATING VALVE ASSEMBLY WITH RESILIENT DEFORMABLE ENGAGING ELEMENT

(76) Inventors: Raymond Hofman, Midland, TX (US); William Sloane Muscroft, Midland, TX (US); Bryan Fitzhugh, Midland, TX (US)

( * ) Notice: Subject to any disclaimer, the term of this patent is extended or adjusted under 35 U.S.C. 154(b) by 733 days.

(21) Appl. No.: 13/423,154

(22) Filed: Mar. 16, 2012

(65) Prior Publication Data

US 2013/0068474 A1 Mar. 21, 2013

Related U.S. Application Data

(60) Provisional application No. 61/453,281, filed on Mar. 16, 2011.

(51) Int. Cl.

| | |
|---|---|
| ***E21B 34/08*** | (2006.01) |
| ***E21B 34/14*** | (2006.01) |
| *E21B 43/14* | (2006.01) |
| *E21B 43/26* | (2006.01) |

(52) U.S. Cl.

CPC ..... *E21B 34/08* (2013.01); *E21B 34/14* (2013.01); *E21B 43/14* (2013.01); *E21B 43/26* (2013.01)

(58) Field of Classification Search

CPC ..... E21B 34/08; E21B 34/14; E21B 43/14; E21B 43/26; E21B 34/10; E21B 34/00

USPC ..... 166/318, 373, 193; 175/268, 270

See application file for complete search history.

(56) References Cited

U.S. PATENT DOCUMENTS

| | | | | |
|---|---|---|---|---|
| 5,086,613 | A * | 2/1992 | Fox et al. | 56/10.9 |
| 5,375,662 | A * | 12/1994 | Echols et al. | 166/386 |
| 7,108,067 | B2 * | 9/2006 | Themig et al. | 166/317 |
| 7,322,417 | B2 * | 1/2008 | Rytlewski et al. | 166/313 |
| 8,403,068 | B2 * | 3/2013 | Robison et al. | 166/386 |
| 2003/0164251 | A1 * | 9/2003 | Tulloch | 175/57 |
| 2004/0011566 | A1 * | 1/2004 | Lee | 175/317 |
| 2006/0011347 | A1 * | 1/2006 | Reimert | 166/345 |
| 2006/0108152 | A1 * | 5/2006 | Lee | 175/317 |
| 2006/0243455 | A1 * | 11/2006 | Telfer et al. | 166/386 |
| 2007/0272420 | A1 * | 11/2007 | Reimert et al. | 166/387 |
| 2009/0044955 | A1 * | 2/2009 | King et al. | 166/374 |
| 2009/0084555 | A1 * | 4/2009 | Lee | 166/319 |
| 2010/0065125 | A1 * | 3/2010 | Telfer | 137/1 |
| 2011/0186355 | A1 * | 8/2011 | Telfer | 175/57 |
| 2012/0067595 | A1 * | 3/2012 | Noske et al. | 166/373 |
| 2012/0073827 | A1 * | 3/2012 | Kenyon et al. | 166/373 |
| 2013/0068474 | A1 * | 3/2013 | Hofman et al. | 166/373 |

(Continued)

*Primary Examiner* — Daniel P Stephenson

(57) ABSTRACT

An apparatus, system and method relating to a valve assembly for use in a subterranean well for oil, gas, or other hydrocarbons. The valve assembly comprises an engaging element with a resilient portion having a first shape when a first pressure differential is applied across the engaging element in a direction and a second shape when a second pressure differential is applied across the element in the direction; a receiving element having sealing section; wherein the engaging element is engagable with the first receiving element to substantially prevent the flow of fluids through the sealing section a pressure differential is applied to the engaging element that is less than a first pressure differential; wherein the engaging element is extrudable through the first receiving element by applying a second pressure differential that is greater than the first pressure differential.

24 Claims, 7 Drawing Sheets

(56) References Cited

U.S. PATENT DOCUMENTS

2013/0068475 A1* 3/2013 Hofman et al. ..... 166/373
2013/0168087 A1* 7/2013 Linklater et al. ..... 166/250.17
2013/0180721 A1* 7/2013 Getzlaf et al. ..... 166/308.1
2013/0299199 A1* 11/2013 Naedler et al. ..... 166/386
2014/0151054 A1* 6/2014 Norrid ..... 166/318
2014/0246209 A1* 9/2014 Themig et al. ..... 166/374

* cited by examiner

DOWNHOLE SYSTEM AND APPARATUS INCORPORATING VALVE ASSEMBLY WITH RESILIENT DEFORMABLE ENGAGING ELEMENT

CROSS-REFERENCES TO RELATED APPLICATIONS

This original nonprovisional application claims the benefit of U.S. Provisional Application Ser. No. 61/453,281, filed Mar. 16, 2011 and entitled "Multistage Production System Incorporating Downhole Tool With Deformable Ball," which is incorporated by reference herein.

STATEMENT REGARDING FEDERALLY-SPONSORED RESEARCH OR DEVELOPMENT

Not applicable.

BACKGROUND

1. Field of the Invention

The embodiments disclosed herein and the invention as claimed relate to a valve assembly to prevent the flow of fluids past the assembly, to systems incorporating such assembly, and to methods for using the assembly. In one preferred embodiment, the valve assembly is incorporated into a system of selectively operable frac sleeves for use in completing a well for oil, gas or other hydrocarbons.

2. Background

In hydrocarbon wells, tools incorporating valve assemblies having an engaging element, such as a ball or dart, and a receiving element, such as a ball seat or dart seat, have been used for a number of different operations. Such valve assemblies prevent the flow of fluid past the assembly and, with the application of a desired pressure, a well operator can actuate one or more tools associated with the assembly.

One use for such remotely operated valve assemblies is in fracturing (or "fracing"), a technique used by well operators to create and/or extend one or more cracks, called "fractures" from the wellbore deeper into the surrounding formation in order to improve the flow of formation fluids into the wellbore. Fracing is typically accomplished by injecting fluids from the surface through the wellbore and into the formation at high pressure to create the fractures and to force them to both open wider and to extend further. In many case, the injected fluids contain a granular material, such as sand, which functions to hold the fracture open after the fluid pressure is reduced.

Fracing multiple-stage production wells requires selective actuation of downhole tools, such as fracing sleeves, to control fluid flow from the tubing string to the formation. For example, U.S. Published Application No. 2008/0302538, entitled Cemented Open Hole Selective Fracing System and which is incorporated by reference herein, describes embodiments which incorporate a shifting tool for selectively actuating a fracing sleeve.

That same application also describes a system using multiple valve assemblies which incorporate ball-and-seat seals, each having a differently-sized ball seat and corresponding ball. Frac valves connected to ball-and-seat arrangements do not require the running of a shifting tool thousands of feet into the tubing string and are simpler to actuate than frac valves requiring such shifting tools. Such ball-and-seat arrangements are operated by placing an appropriately sized ball into the well bore and bringing the ball into contact with a corresponding ball seat. The ball engages on a section of the ball seat to block the flow of fluids past the valve assembly. Application of pressure to the valve assembly causes the valve assembly to "shift," opening the frac sleeve to the surrounding the formation.

Some valve assemblies are selected for tool actuation by the size of ball introduced into the well. If the well or tubing string contains multiple ball seats, the ball must be small enough that it will not seal against any of the ball seats it encounters prior to reaching the desired ball seat. For this reason, the smallest ball to be used for the planned operation is the first ball placed into the well or tubing and the smallest ball seat is positioned in the well or tubing the furthest from the wellhead. Thus, these valve assemblies limit the number of valves that can be used in a given tubing string because each ball size is only able to actuate a single valve. Further, systems using these valve assemblies require each ball to be at least 0.125 inches larger than the immediately preceding ball. Therefore, the size of the liner restricts the number of valve assemblies with differently-sized ball seats. In other words, because a ball must be larger than its corresponding ball seat and smaller than the ball seats of all upwell valves, each ball can only seal against a single ball seat and, if desired, actuate one tool.

The embodiments disclosed herein relate to an alternative for sequentially engaging multiple receiving elements with a single engaging element and, where desired, actuating tools associated with the valve assembly. One embodiment of the present invention allows multiple balls of the same size to actuate tools in sequential stages.

In fracing operations, the embodiments of the valve assembly disclosed herein, enable an increase in the number of stages that can be performed using ball-and-seat or similar valve assemblies. The increase in frac stages can increase the total number of sleeves that can be opened for fracture treatments, reduce the number of frac valves that are opened for each stage, or both. Further, if additional stages are not needed, the invention valve assembly such as those disclosed herein can be used to limit the valve assemblies used to those having larger diameter balls and ball seats, thus enlarging the fluid path in the wellbore or tubing and improving the flow of fluids form the wellhead to the formation to be treated.

In an alternate aspect, valve assemblies such as those disclosed herein are useful to perform multiple pressure cycles on installed tubing by using a single engaging element sequentially on multiple receiving elements or by sequential engagement of a single receiving element with multiple engaging elements.

DESCRIPTION OF THE EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracturing, or "fracing," process, fracing fluids and/or gasses move from the surface in the downwell direction to the portion of the tubing string within the formation.

Figure 1:
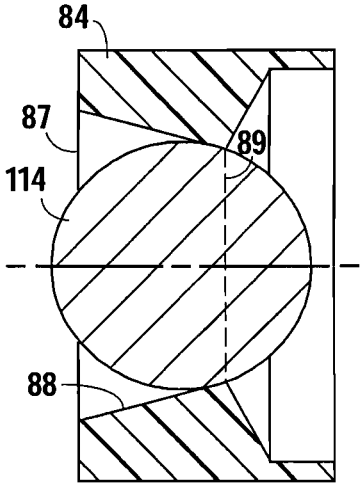
FIG. 1 is a sectional elevation illustrating an embodiment of the valve assembly of the present invention.

FIG. 1 shows an illustrative embodiment of a valve assembly. In this embodiment, the engaging element 114 is a ball that is engageable with a receiving element 84, which is in this case a ball seat having a sealing section 88 partially defined by an inlet 87 on one end and an opposing outlet 89. Engagement of the engaging element 114 with the receiving element 84 functions to create a fluid seal that minimizes and inhibits fluid from flowing through receiving element 84.

In the illustrative embodiment of FIG. 1, the receiving element 84 contains a sealing section 88 with a generally conical profile such that the inlet 87 of the sealing section 88 has a diameter greater than diameter of the engaging element 114 and the outlet 89 of sealing section 88 has a diameter smaller than the diameter of engaging element 114. The distance between the inlet 87 and outlet 89 combined with the difference between their diameters define an angle of the seating section's 88 generally conical profile.

In operation, the diameter of the engaging element contacts sealing section 88 between inlet 87 and outlet 89. When the pressure at inlet 87 exceeds the pressure at outlet 89, the engaging element begins to compress or deform, or both, causing the diameter of the engaging element which is contact with seating section 88 to shrink, allowing the engaging element to move towards outlet 89. If the pressure differential between inlet 87 and outlet 89 is sufficiently high, the diameter of the engaging element 114 which contacts seating section 88 shrinks to the diameter of the outlet 89, or to a diameter slightly smaller than the diameter of outlet 89, allowing the engaging element 114 to pass through the outlet 89 and out of the receiving element 84. As appreciated by those of skill in the art, the passage of engaging element 114 through the outlet 89 of the receiving element 84 allows the pressure at outlet 89 to equalize with the pressure at inlet 87.

In one preferred embodiment, the hardness of the ball seat 84 is greater than the hardness of the ball 114. Thus, as force is applied to the ball 114 while in the seating section 88, the ball 114 compresses or otherwise deforms before the ball seat 84 expands. More particularly, the ball 114 compresses or deforms sufficiently to pass through the outlet 89 of the ball seat 84 while the diameter of the outlet 89 remains substantially the same. After passing through the outlet 89, the ball 114 returns substantially back to its original size and shape.

Although virgin PEEK is preferred, other contemplated materials may be used provided that they will predictably deform yet are substantially resilient. For example, one embodiment of the invention contemplates the use of a "carbon black" ball, or CB ball, which is a PEEK ball to which carbon fibers have been added to increase compressive strength. CB balls have a higher pressure limit than the preferred virgin PEEK in a given size, but are more prone to cracking. Yet another alternative is polyamide-imides, such as those sold under the trade name TORLON by Solvay Advanced Polymers of Alpharetta, Ga.

Figure 2:
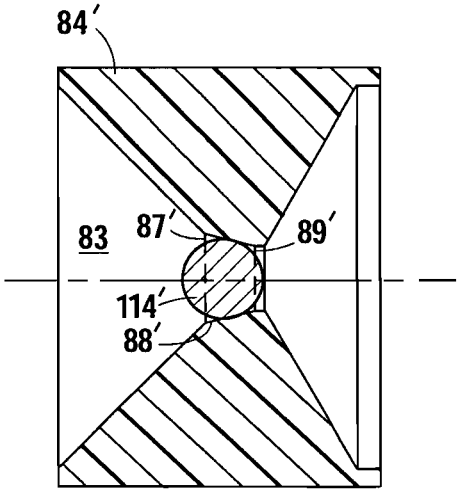
FIG. 2 is a sectional elevation of an alternative embodiment receiving element of the present invention.

FIG. 2 shows an alternative ball seat 84' from a preferred embodiment, which is for use with a ball 114' the diameter of which is small relative to the outer diameter of the ball seat 84'. Like the ball seat 84 shown in FIG. 1, the ball seat 84' of FIG. 2 has a sealing section 88' with an inlet 87' and outlet 89' and the distance between inlet 87 and outlet 89 defines an angle of the generally conical profile. The ball seat 84' of FIG. 2 has an "entry section" 83 to funnel the ball 114' into the seating section 88', thereby helping to ensure that a ball of relatively small diameter will engage with the appropriate seating section 88'. Such entry section may be present or absent in ball seats or other receiving elements of the present invention.

In a preferred embodiment, the fluid pressure that the valve assembly will hold is determined by the physical properties of the engaging element, including its size, shape, and material composition, and the diameter of the outlet 89' of seating section 88'. Specifically, when the fluid pressure is greater at the inlet 87' than at the outlet 89', the engaging element is forced towards the outlet. If this difference in pressure between the inlet and outlet (i.e., the "pressure drop") becomes sufficiently high, the engaging element is forced through the inlet and can then move down the well or tubing to engage the next seat. The pressure drop necessary to force the engaging element through its corresponding seat or other receiving element is a function of the size of the outlet 89 as well as the size of the engaging element and the materials used to make the engaging element.

For example, referring back to FIG. 1, the valve assembly may comprise a ball seat 84 with an outlet 89' diameter of 3.75 inches for use with a virgin PEEK ball 114 sized for a one-sixteenth inch interference fit with the outlet 89. These conditions generally require application of approximately one thousand pounds per square inch of pressure differential across the ball 114 to cause the ball to extrude through seat 84. A CB ball of the same size extrudes through outlet 89 at approximately two thousand to two thousand two hundred pounds per square inch.

Because the force applied to any given ball is a function of the square of the diameter, the size of the interference fit may be adjusted with different ball sizes so that the pressure necessary to move the ball through the seat 84 is the same, regardless of ball size. For example, if the well operator desires that all balls within a system extrude through the seat at the same pressure (e.g., 2200 psi), larger balls will require a tighter interference fit because of the increased force on the ball resulting from the larger surface area exposed to the tubing pressure. Similarly, smaller balls will require a smaller interference fit for the same pressure to be operative.

The inlet-to-outlet length is preferably one-eighth inch, which allows the ball to extrude through the outlet nearly immediately upon application of the target pressure differential. Increasing the length of the inlet-to-outlet length increases the effect of friction on the ball, which may increase the required time and/or pressure to move the ball 114 through the outlet 89.

The valve assembly's 84 pressure rating can be adjusted by changing, the diameter of the outlet 89, the physical properties of the engaging element 114, or combinations of the above. Changing the angle of the conical profile of seating section 88 may also increase friction and thereby increase the pressure rating or the time required for the ball to extrude in response to its rated pressure. Experiments performed on valve assemblies 84 comprising spherical engaging elements 114 and ball seat receiving elements 84 have identified valve assemblies with interference diameters of $1/16^{th}$ inch having pressure ratings ranging from less than 1000 psi using virgin PEEK to over 2200 psi using CB ball. Valve assemblies 84 comprising balls made from virgin PEEK as the engaging element 114 have demonstrated pressure ratings of from less than 1000 psi for interference diameters of $1/16^{th}$ inch to over 2200 psi for interference diameters of about $1/8^{th}$ inch. As used herein, the term "interference diameter" means the difference between the uncompressed diameter of the ball—or equivalent cross section of a non-spherical engaging element—and the diameter of the outlet 89.

Further, the valve assembly of the present invention encompasses receiving elements with outlets that can expand due to the application of pressure on the valve assembly, provided that such receiving element does not expand to the point that the outlet of the receiving element is as large as or larger than the uncompressed diameter of the ball or equivalent cross section of a non-spherical engaging element. Receiving elements with expandable outlets can be used to create a valve assembly in which the engaging element passes through the receiving element at lower pressure than required for valve assemblies with an outlet that does not expand.

Figure 3A:
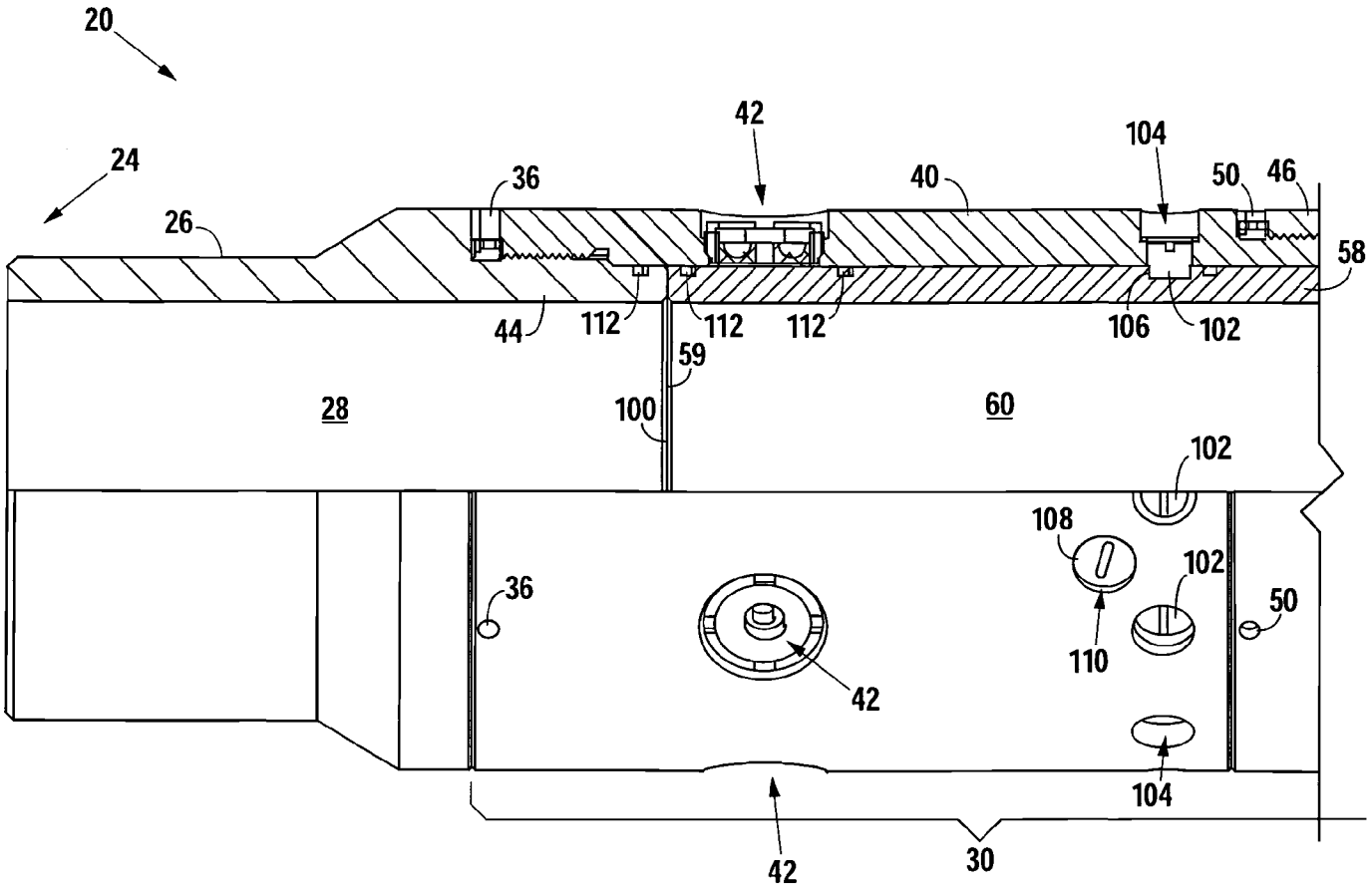
FIGS. 3A-3B are partial sectional elevations of the preferred embodiment of the present invention in a "run-in" state.
Figure 3B:
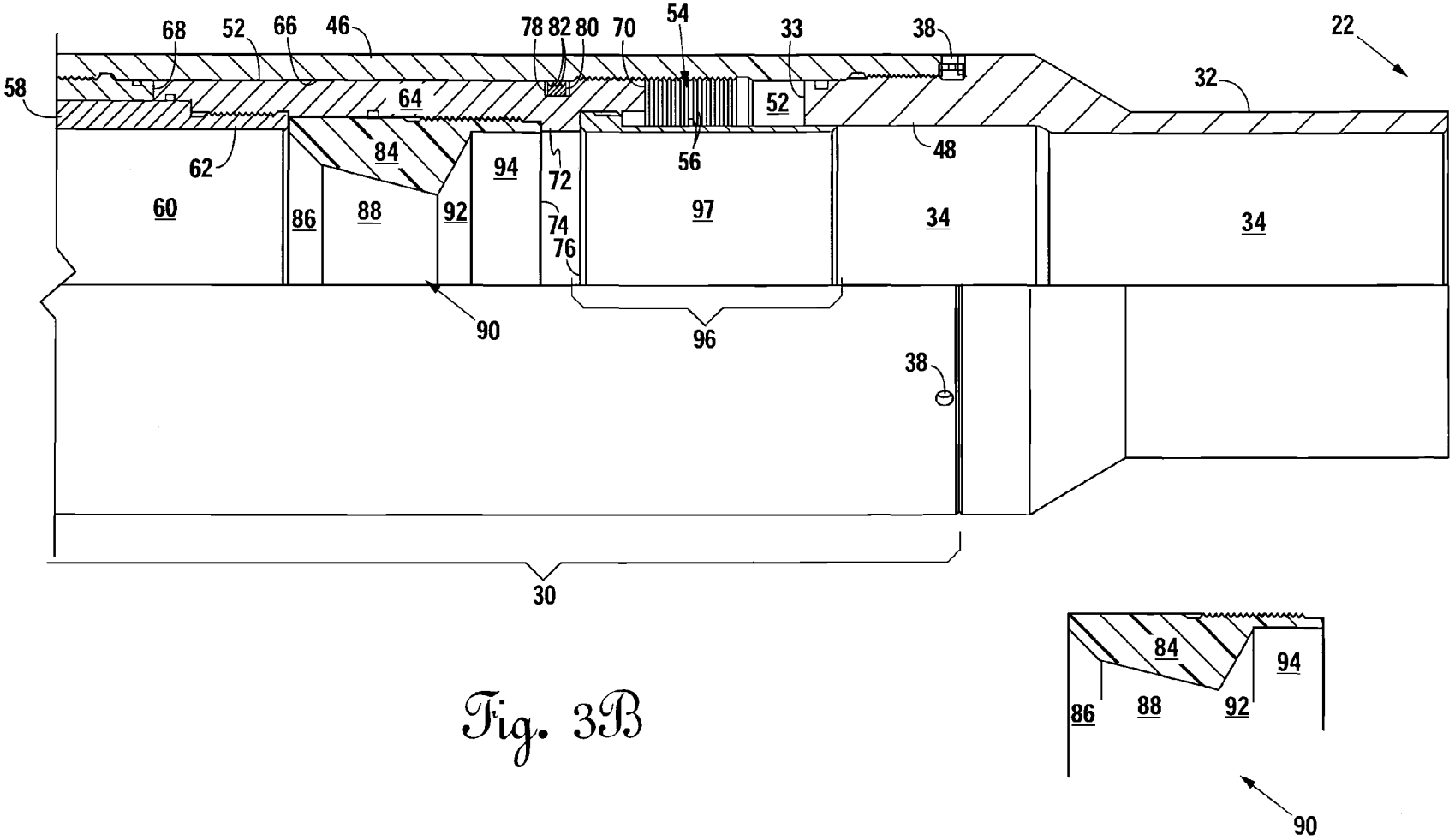

FIGS. 3A-3B disclose a downhole tool 20 incorporating one embodiment of the present invention as it could be installed in a wellbore. Hydrocarbon fluids generally pass through an internal flowpath from the lower end 22 of the tool 20 to the upper end 24 of the tool during production, and treating fluids generally pass through the internal flowpath from the upper end 24 of the tool 20 to the lower end 22 of the tool 20 when the surrounding formation is being treated. The tool 20 has a top connection 26 with a first cylindrical inner surface 28, a housing assembly 30, and a bottom connection 32 having an annular upper end surface 33 and a cylindrical inner surface 34. The top connection 26 and bottom connection 32 are fixed to the housing assembly 30 with upper and lower sets of screws 36, 38 respectively.

The housing assembly 30 includes an upper housing 40 with a plurality of radially-directed and circumferentially-aligned ports 42 providing fluid communication paths between the internal flowpath and the surrounding formation. In the illustrated embodiment, the ports 42 are generally circular and contain an insert. However, tools incorporating embodiments of the present invention may have any size or shape, and either have inserts or be open to the well bore. In some preferred embodiments, the ports 42 are configured so that flow is prevented through the port by a sleeve until the valve assembly is activated by a required pressure. The upper set of screws 36 extends through the upper housing 40 to engage a lower portion 44 of the top connection 26.

The housing assembly 30 further includes a lower housing 46. The lower set of screws 38 extends through the lower housing 46 to engage an upper portion 48 of the bottom connection 32. The lower housing 46 is fixed to the lower end of the upper housing 40 with an intermediate set of screws 50. The lower housing 46 includes an inner cylindrical surface 52 with a locking section 54 having a plurality of radially-inward directed dogs 56.

An annular sleeve 58 is positioned downwell of the top connection 26 and radially within the housing assembly 30. The sleeve 58 has a cylindrical inner surface 60 having the same diameter as the cylindrical surface 28 of the top connection 26.

Referring specifically to FIG. 3B, a lower end 62 of the sleeve 58 is fixed to and nested within a generally annularly ball seat carrier 64. The ball seat carrier 64 has a cylindrical outer surface 66 adjacent to the inner surface 52 of the lower housing 46.

The outer surface 66 extends between annular upper and lower end surfaces 68, 70. A shoulder 72 having upper and lower annular shoulder surfaces 74, 76 extends radially inward from the inner cylindrical surface. The outer surface 66 of the ball seat carrier 64 defines a lock ring groove 78 that is radially aligned and with the shoulder 72. An annular lock ring 80 having radially-outwardly oriented dogs 82 is positioned in the lock ring groove 78. The lock ring 80 has normal outer diameter greater than the inner diameter of the inner surface 52 and is radially compressed into the lock ring groove 78 and exerts a radially-outward force against the inner surface 52.

One embodiment of a receiving element, a ball seat 84, is positioned between the sleeve 58 and the upper shoulder surface 74 of the ball seat carrier 64 to hold the ball seat 84 in a fixed position relative to the sleeve 58 with an upper end surface adjacent to the lower end surface of the sleeve 58. As described with reference to FIG. 1, the ball seat 84 has partially-conical seating surface 86, a partially-conical passage surface 88 defining a ball seat passage 90 through the insert 88. A lower partially-conical surface 92 extends from the flow path surface to a lower partially cylindrical surface 94.

A generally cylindrical lower sleeve 96 extends from the lower shoulder surface 76 of the ball seat carrier 64 to the interior space of the bottom connection 32. The lower sleeve 96 is fixed to the ball seat carrier 64 and moves longitudinally therewith.

FIGS. 3A-3B show the upper sleeve 58 in an upwell first position having an upper annular surface 98 contacting the annular lower surface 100 of the top connection 26. In this position, the inner sleeve 58 is radially between the ports 42 and the center of the flowpath. A plurality of circumferentially-aligned sacrificial parts (e.g., shear pins 102) extends through shear pin holes 104 formed through the upper housing 40 and engages with corresponding shear pin slots 106 formed in the outer surface of the sleeve 58. A torque pin 108 extends through a torque pin hole 110 formed in the top connection 26 and engages the sleeve 58. A plurality of upper engaging elements 112 is positioned proximal to the top connection 26, the sleeve 58, the ports 42, and the upper housing 26 to inhibit unintended fluid flow between the flowpath and the ports 42.

Figure 4:
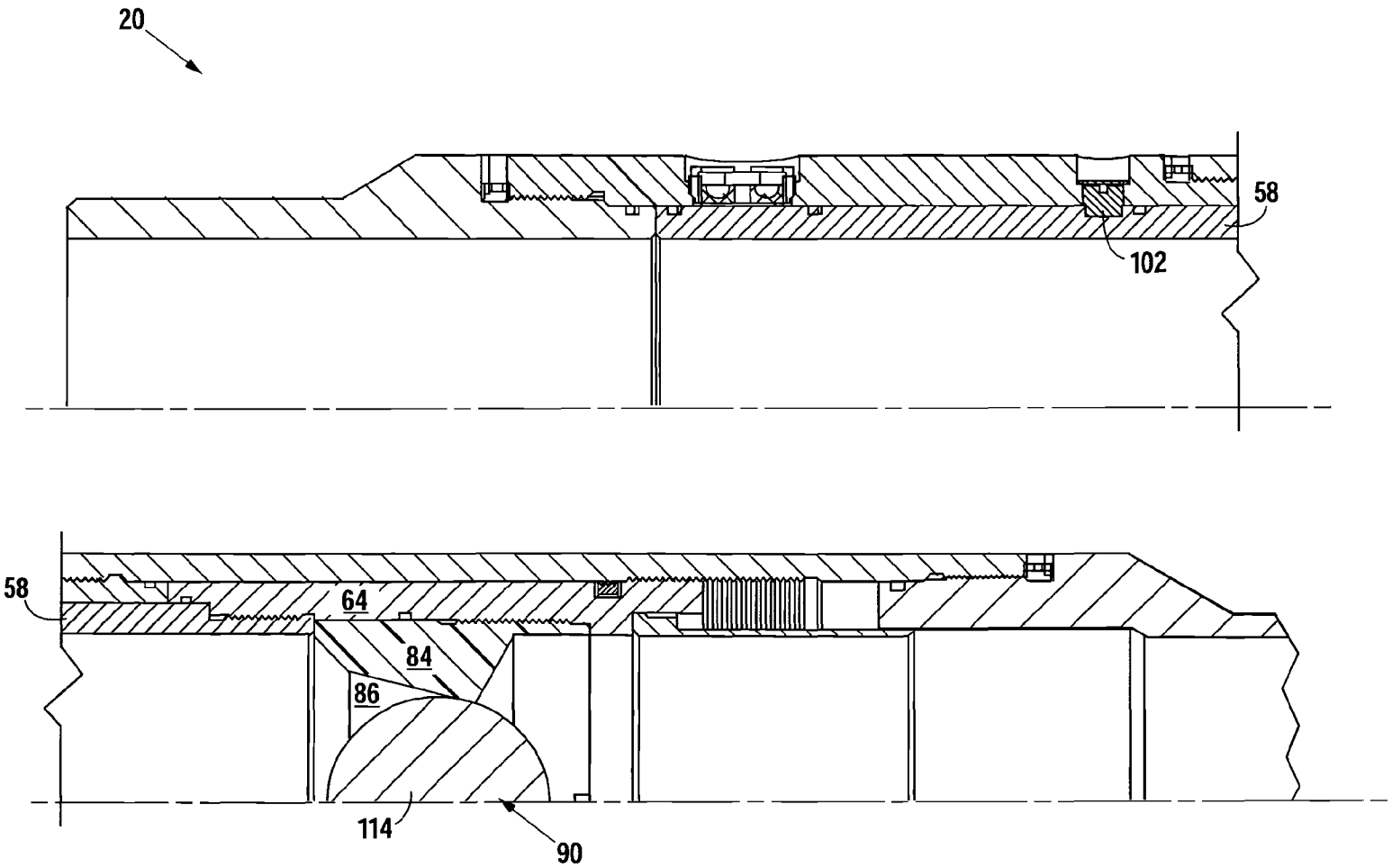
FIG. 4 is a partial sectional elevation of the embodiment shown in FIG. 3A-3B wherein a ball is engaged with the ball seat.

FIG. 4 shows an embodiment of an engaging element 114, in this case a ball, seated against the seating surface 86 of the ball seat 84. In this position, the engaging element 114 blocks fluid flow from inlet 87 to outlet 89, thereby preventing flow through passage 90. This allows the pressure within the flowpath to be increased at inlet 87 to create a differential pressure across the engaging element 114. As a result, force is directed against the engaging element 114, seating section 88, and other areas of receiving element 84 which lie between the inlet 87 and outlet 89. The engaging element 114 and receiving element 84, in turn, exert a downwell-directed pulling force on the ball seat carrier 64 and the sleeve 58, which force is resisted by the shear pins 102. Despite creation of such a pressure differential, the ball 114, ball seat 84, ball seat carrier 64, and inner sleeve 58 are fixed in the position shown in FIG. 2 until the downwell-directed pulling force on the sleeve 58 exceeds the shear pin rating and is sufficient to fracture the shear pins 102.

Figure 5:
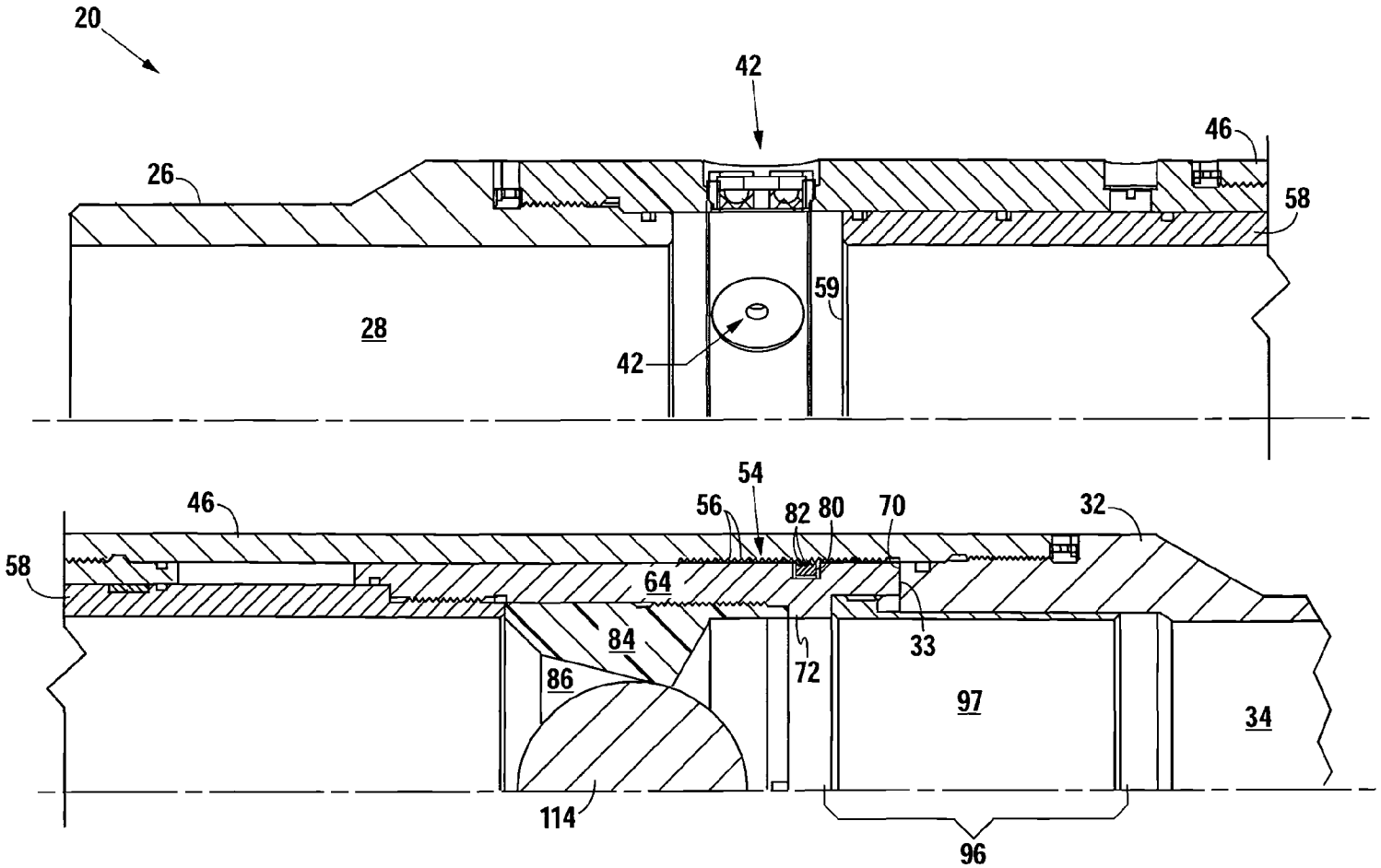
FIG. 5 is a partial sectional elevation of the embodiment shown in FIGS. 3A, 3B and 4 wherein the sleeve has been shifted to a second, downwell position.

FIG. 5 shows the tool in a second state in which the ball seat carrier 64, ball seat 84, and sleeve 58 have been shifted from the position shown in FIG. 2 to a downwell second position. In this second position, the annular lower end surface 70 of the ball seat carrier 64 contacts the annular upper end surface 33 of the bottom connection 32. The locking ring 80 is positioned in the locking section 54 of the lower housing 46. The dogs 82 of the locking ring 80 are engaged with the inwardly-oriented dogs 56 of the locking section 54, which inhibits upwell movement of the ball seat carrier 64 relative to the lower housing 46. Because the locking ring 80 is in a compressed state, the locking ring 80 exerts a radially expansive force against the inner surface 52 (see FIG. 1B) of the lower housing 46 and inhibits inadvertent disengagement of the ring dogs 82 from the housing dogs 56.

In the second position, the upper end surface 59 of the sleeve 58 is positioned downwell of the housing ports 42. Thus, when the sleeve 58 is in the second position, fluid flow is permitted between the interior flowpath and the exterior of the tool through housing ports 42.

When the sleeve 58 is in the second position shown in FIG. 4, the well operator may thereafter cause treating fluids to flow through the flowpath of the well. Flow of such materials will be blocked from downwell flow by the engaging element 114 positioned against the seating surface 86, causing flow to be directed to the surrounding formation through the housing ports 42.

After fracing, the differential pressure across the ball 114 may be increased to cause the ball 114 to extrude through the passage 90 of the ball seat 84 and extrude to the next tool in the tubing string or, alternatively, the end of the tubing string. The ball seat 84 may then be milled to remove the passage 90 and increase the flow profile for fluids.

For any given state, the profile of the flowpath is a function of the position of the sleeve 58. In FIGS. 3A-3B, the inner surface 26 of the top connection 26, inner surface 60 of the sleeve 58, surfaces of the ball seat 84, shoulder 72 of the ball seat carrier 64, and inner surface 97 of the lower sleeve 96, and inner surfaces 34 of the bottom connection 32 define the internal flowpath between the upper end 24 and lower end 22 of the tool 20. In FIG. 3, the interior flowpath of the tool is defined by the inner surface 28 of the top connection 26, the inner surface 60 of the sleeve 58, the inner surfaces 86, 88, 92, 94 of the ball seat 84, the shoulder 72 of the ball seat carrier 64, the cylindrical inner surface 97 of the lower sleeve 96, and the inner surfaces 34 of the bottom connection 32.

Differently-sized balls and tools may be used within a single tubing string to actuate a series of tools within stages of the well, with tools requiring a smaller ball size being located downwell of tools requiring larger ball sizes. For example, a 1.5-inch diameter ball may be extruded through one or more tools with seats having a 1.4-inch diameter, and then rest against a "static" seat positioned between stages and designed to hold the ball and not allow it to deform or pass therethrough.

Figure 6:
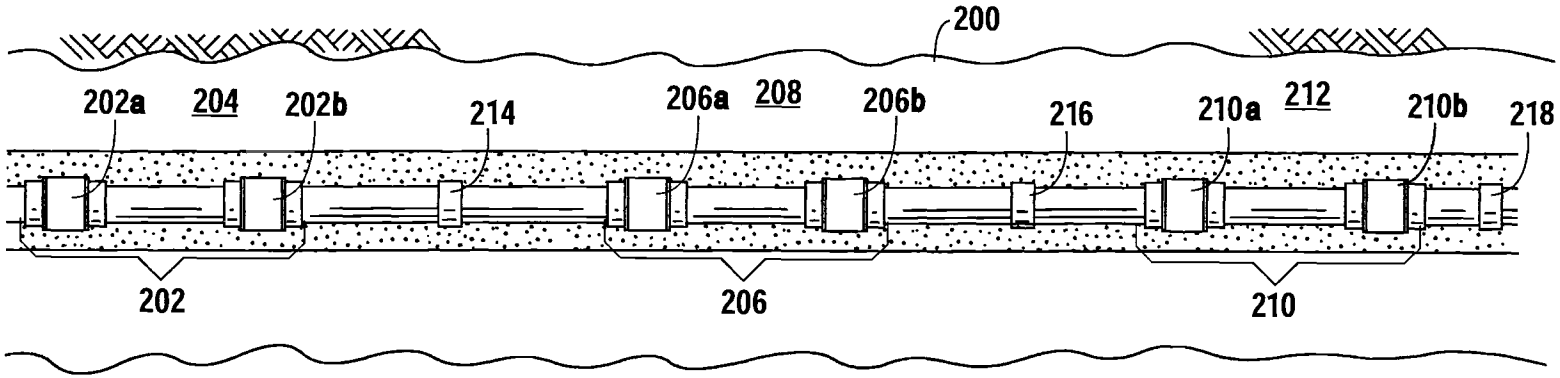
FIG. 6 shows multiple tools having the features described with reference to FIGS. 1-5 in use in a three-stage production system.

FIG. 6 shows a hydrocarbon producing formation 200 and a system comprising incorporating one or more valve assemblies of the present invention. An upper set of tools 202 is positioned in an upper stage 204 of the formation 200, an intermediate set of tools 206 positioned in an intermediate stage 208, and a lower set of tools 210 positioned within a lower stage 212. An upper static-seat tool 214 is positioned between the upper set of tools 202 and the intermediate set of tools 206 and has an internal ball seat with an outlet diameter smaller than the outlet diameters of the upper set of tools. An intermediate static-seat tool 216 is positioned between the intermediate set of tools 206 and the lower set of tools 210 and has an internal ball seat with an outlet diameter smaller than the outlet diameters of the intermediate set of tools. A lower static-seat tool 218 is positioned downwell of the lower set of tools and has an internal ball seat with an outlet diameter smaller than the outlet diameters of the lower set of tools. The static-seat tools 214, 216, 218 have ball seats designed to allow fluid flow therethrough in either the upwell or downwell direction, but the ball seats are not connected to sleeves or other movable components. Further, the outlet diameters of the static-seat tools are configured such that a ball used to activate the sleeves of the stages down well of the static-seat will pass through the static-seat tool and remain able to seal against the its corresponding set of tools. However, the outlet diameter of the static-seat is small enough that the valve formed by engagement of the static seat with the ball used to activate an upwell set of tools will hold sufficient pressure to perform a desired treatment, (e.g. will hold pressure up to at least the desired maximum fracture treatment pressure).

Each tool of the sets of the tools 202, 206, 210 has the features described with reference to FIGS. 1-5. Each tool within the upper set of tools 202 has a ball seat sized to be actuated by the associated upper-stage ball. Each tool within the intermediate set of tools 206 has ball seat sized to be actuated by an associated intermediate ball smaller than the upper-stage ball. Each tool within the lower set of tools 210 has a ball seat sized to be actuated by an associated lower-stage ball, which is smaller than the upper ball, and the intermediate-stage ball.

To actuate the lower set of tools 210, the lower-stage ball is caused to move through the tubing string and upper and intermediate sets of tools 202, 206. The lower-stage ball is sized to pass through the upper and intermediate sets of tools 202, 206 without being inhibited from further downwell flow by the corresponding ball seats.

Upon reaching the upwell tool 210*a* of the lower set of tools 210, the lower-stage ball seats against the ball seat of the tool. The well operator can then increase the pressure within the tubing string to overcome the resistance of the shear pins (e.g., 1800 psi) and shift the sleeve to the second position described with reference to FIG. 3. When desired, the pressure within the flowpath may be increased further to extrude the lower-stage ball through the ball seat passage as described supra. After extruding the lower-stage ball through the passage, the pressure may be decreased to cause the lower-stage ball to seat against the lower tool 210*b* of the lower set of tools 210. While the lower set of tools 210 only shows two tools 210*a*, 210*b*, any number of similar tools may compose this stage. After moving through all of such tools, the lower-stage ball seals against the lower static seat, which is sized to prevent extrusion of the ball therethrough regardless of the pressure within the tubing string. This process may then be repeated, first with the intermediate stage 208 using the intermediate-stage ball with the intermediate sets of tools 206 and the intermediate static-seat tool 216, and second with the upper stage 204 using the upper-stage ball with the upper sets of tools 202 and upper static seat tool 214.

While the lower set of tools is shown comprising only three stages of tools, the process could be repeated for any number of tools within this stage. In addition, the same process described above with respect to the lower set of tools is repeatable in similar fashion for the intermediate and upper sets of tools 202, 206. After performing these steps on the intermediate set of tools, the intermediate ball will flow to and seat against the ball seat of the first tool of the lower set of tools. Likewise, after performing these steps on the upper set of tools, the upper ball will flow to and seat against the ball seat of the first tool of the intermediate set of tools.

Figure 7:
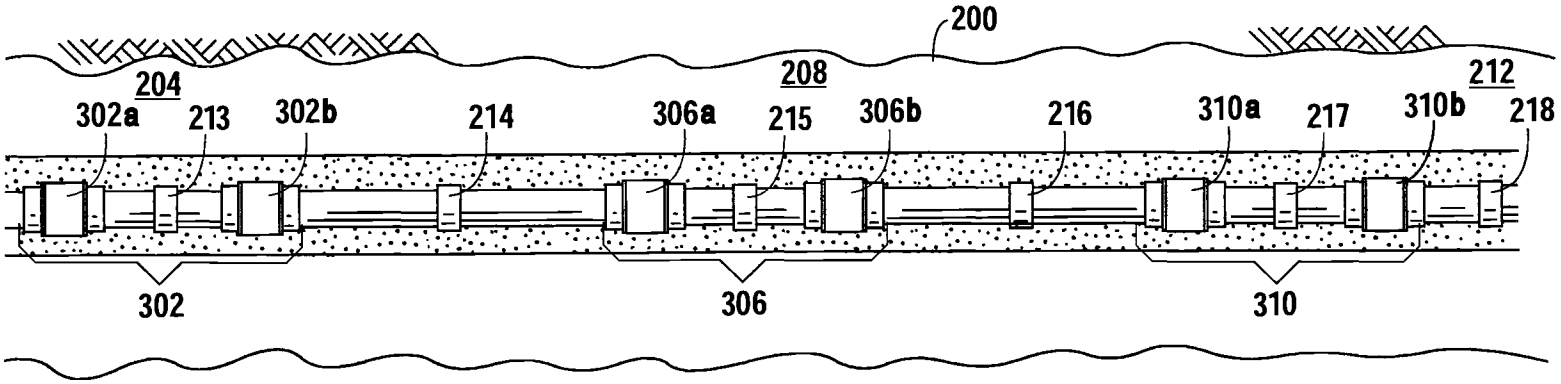
FIG. 7 shows multiple tools having the features described with reference to FIGS. 1-5 in use in a six-stage production system.

FIG. 7 shows a second embodiment of a six-stage system that includes three sets of tools. The system comprises an upper set of tools 302 positioned in an upper stage 204 of the formation 200 described with reference to FIG. 6, an intermediate set of tools 306 positioned in the intermediate stage 208, and a lower set of tools 310 positioned within the lower stage 212.

Each tool of the sets of the tools 302, 306, 310 has the features described with reference to FIGS. 1-5. Each tool 302*a*, 302*b* within the upper set of tools 302 has a ball seat sized to be actuated by an associated upper-stage ball. Each tool 306*a*, 306*b* within the intermediate set of tools 306 has ball seat sized to be actuated by an associated intermediate-stage ball smaller than the upper-stage ball. Each tool 310*a*, 310*b* within the lower set of tools 310 has a ball seat sized to be actuated by an associated lower-stage ball, which is smaller than the upper-stage ball, and the intermediate-stage ball.

In addition, each tool 302*a*, 302*b*, 306*a*, 306*b*, 310*a*, 310*b* of the stages has one or more retention elements which prevent the tool from actuating until the fluid pressure meets a desired minimum. In one preferred embodiment, the retention element comprises one or more shear pins. However, any device, assembly, or mechanism that prevents the tools from actuating until a certain minimum pressure is reach may serve as the retention element.

To fully actuate the system embodied in FIG. 7, three ball sizes—upper-stage, intermediate-stage and lower-stage—and two different ball types are used: The "a" ball seats, found in tools 302*a*, 306*a* and 310*a*, have an interference diameter of 0.0625 inches in relation to the ball size used to activate the tools associated with those seats. The "b" ball seats, found in tools 302*b*, 306*b*, and 310*b*, have an interference diameter of 0.125 inches in relation to the ball size used to activate the tools associated with those seats. The first ball, made of a sufficiently resilient and compressible material, such as virgin PEEK (VP), and sized to activate tool 310*b* passes through upper tool set 302 and intermediate tool set 306 and engages tool 310*a*. Pressure is applied to the first ball which extrudes through the seat at a pressure less than pressure required to activate the tool. For balls made of VP, the pressure required to extrude is about 1000 psi. The first ball then engages tool 310*b* and pressure is applied to this valve assembly. The 0.125 inch interference diameter prevents the ball from extruding through the seat of tool 310*b* until after the pressure rating of the shear pins, is exceeded and the tool is activated. In one preferred embodiment, the shear pins have a pressure rating of about 1800 psi. Upon application of additional pressure, the ball is extruded through tool 310*b* and subsequently engaged on the seat of static seat tool 218.

A second ball having the same diameter as the first ball, and comprising a second, less compressible material is then introduced into the well. One example of a suitable second material is carbon black, that is PEEK into which carbon fibers have been introduced. The second ball passes through upper tool set 302 and the intermediate tool set 306 and engages tool 310*a* Pressure is applied to the valve assembly until the pressure exceeds the rating of the shear pins or other retaining elements, actuating the tool. Additional pressure is applied to extrude the second through the seat of tool 310*a* and the second ball engages a second static-seat tool 217, positioned between tool 310*a* and 310*b*.

This process may then be repeated, first with the intermediate stage 208 using the VP and CB intermediate-stage balls with the intermediate sets of tools 206 and the intermediate static-seat tool 216, and second with the upper stage 204 using VP and CB upper-stage ball with the upper sets of tools 202 and upper static seat tool 214.

The pressures and materials used to describe operation of the system of FIG. 7 are examples only, and are not intended to limit the materials or pressures which be used for the system's operation. A ball is used in the preferred embodiments but it should be understood that the use of the term ball or sphere is not limiting and the engaging element can be any geometric shape that is capable of engaging a seat to inhibit flow through the seat. Moreover, the present invention is described in terms of preferred embodiments in which specific systems, tools, and methods are described. Those skilled in the art will recognize that alternative embodiments of such systems and tools, and alternative applications of the methods, can be used in carrying out the present invention. Other aspects and advantages of the present invention may be obtained from a study of this disclosure and the drawings, along with the appended claims. Moreover, the recited order of the steps of the method described herein is not meant to limit the order in which those steps may be performed.

We claim:

1. A system of valve assemblies for use in a subterranean well, for oil, gas, or other hydrocarbons, said system comprising:

an engaging element formed of a resilient deformable material;

a first receiving element having a sealing section engagable with said engaging element;

a second receiving element having a sealing section engagable with said engaging element;

wherein said engaging element is engagable with the sealing section of said first receiving element to form a fluid seal having a first pressure rating, and wherein said engaging element is extrudable through said first receiving element upon application of a second pressure differential that exceeds the first pressure rating; and wherein said engaging element is matable to said second receiving element to form a fluid seal after having passed through said first receiving element.

2. The system of valve assemblies of claim 1 wherein said second receiving element has substantially the same profile as said first receiving element.

3. The system of valve assemblies of claim 1 wherein said engaging element returns to substantially its original size and shape after passing through said first receiving element.

4. The system of valve assemblies of claim 1 wherein said engaging element and said second receiving element are configured to form a fluid seal up to the first pressure differential after the engaging element is extruded through said first receiving element.

5. A multistage system for a hydrocarbon production well, the system comprising:

a first engaging element having a first compressive strength;

a second engaging element having a second compressive strength greater than the first compressive strength;

a first valve assembly having a receiving element engagable with said first and second engaging elements to form a fluid seal, wherein the first valve assembly is mechanically connected to a first plurality of sacrificial parts having a first rating;

a second valve assembly positioned upwell of the first valve assembly and having a receiving element engagable with said first and second engaging element to form a fluid seal, wherein the second valve assembly is mechanically connected to a second plurality of sacrificial parts having a second rating greater than the first rating;

wherein said first engaging element is extrudable through the first and second receiving elements upon application of at least a first pressure differential;

wherein said second engaging element is extrudable through said first and second receiving elements upon application of at least a second pressure differential;

wherein the first rating is greater than the first pressure differential and less the second pressure differential; and wherein the second rating is less than the first and second pressure differentials.

6. A valve assembly for use in a subterranean well for oil, gas, or other hydrocarbons, said seal assembly comprising:

a receiving element with an outlet, an engaging element, configured to engage with said receiving element, and a sacrificial part wherein, engagement of the engaging element with the receiving element inhibits the flow of fluid through the valve assembly up to a first pressure, the engaging element is configured to pass through the outlet of said receiving element at a second pressure without deforming the outlet, the engaging element comprises a material such that the engaging element returns to substantially its original size and shape after the engaging element passes through the receiving element, and the sacrificial part has a pressure rating higher than the second pressure.

7. The valve assembly of claim 6 wherein said engaging element is a ball.

8. The valve assembly of claim 6 wherein said engaging element is a dart.

9. The valve assembly of claim 6 wherein said engaging element comprises poly ether ether ketone.

10. The valve assembly of claim 6 wherein the engaging element is not plastically deformed after passing through the receiving element.

11. The valve assembly of claim 6 wherein said engaging element comprises a material selected from the list consisting of virgin poly ether ether ketone, carbon black, or TORLON®.

12. The valve assembly of claim 6 wherein the receiving element comprises a circular outlet deformable to a diameter less than the undeformed diameter of the engaging element.

13. A method for treating a well for oil, gas or other hydrocarbons, said well containing a first receiving element having a first inlet and a first outlet and a second receiving element having a second inlet and a second outlet, said method comprising, engaging the first receiving element with a first engaging element;

causing said first engaging element to pass through said first outlet at a first pressure drop from the first inlet to the first outlet without substantially changing the size of the first outlet and without substantially changing the shape of the first outlet;

engaging the second receiving element with the first engaging element;

actuating a tool in communication with the second receiving element by application of a second pressure drop from the second inlet to the second outlet.

14. The method of claim 13 wherein the first engaging element actuates a tool in communication with the first receiving element.

15. The method of claim 13 wherein the first engaging element is selected from balls and darts.

16. The method of claim 13 wherein the first outlet and the second outlet have substantially the same size and shape.

17. The method of claim 13 wherein the first pressure drop is at least 1800 psi.

18. The method of claim 13 wherein the first pressure drop is less than the second pressure drop.

19. The method of claim 13 wherein a second engaging element actuates a tool in communication with the first receiving element.

20. A system of valve assemblies for use in a well for oil, gas or other hydrocarbons, said system comprising a first receiving element comprising a first outlet of a first size and a first seating element, a second receiving element comprising a second outlet of a second size and a second seating element, a third receiving element with a third outlet of a third size and a third seating element, a fourth receiving element with a fourth outlet of a fourth size and a fourth seating element, a first engaging element configured to engage the first seating element and the second seating element, a second engaging element configured to engage the third seating element and the fourth seating element, wherein the first engaging element is extrudable through the first receiving element at a first receiving element inlet pressure and is engagable with second receiving element to create a fluid seal preventing fluid communication therethrough; and the second engaging element is extrudable through the third receiving element at a third receiving element inlet pressure and is engagable with fourth receiving element to create a fluid seal therethrough.

21. The system of claim 20 wherein the first engaging element is of substantially the same size and same shape as the second engaging element.

22. The system of claim 21 wherein the first engaging element comprises a different material than the second engaging element.

23. The system of claim 1 wherein the first engaging element is a ball comprising virgin poly ether ether ketone and the second engaging element is a ball comprising carbon black.

24. The system of claim 20 wherein the first engaging element has a maximum diameter substantially the same as a maximum diameter of the second engaging element.

* * * * *